US006345559B1

(12) United States Patent
Wang

(10) Patent No.: US 6,345,559 B1
(45) Date of Patent: Feb. 12, 2002

(54) RATCHET WRENCH HAVING A LABOR SAVING STRUCTURE

(76) Inventor: Yen-Huet Wang, 58, Ma Yuan West St., Taichung (TW)

( * ) Notice: Subject to any disclaimer, the term of this patent is extended or adjusted under 35 U.S.C. 154(b) by 0 days.

(21) Appl. No.: 09/792,662

(22) Filed: Feb. 22, 2001

(51) Int. Cl.[7] ..... B25B 13/46
(52) U.S. Cl. ..... 81/466; 81/62; 81/177.2
(58) Field of Search ..... 80/60–63.2, 177.2, 80/463, 465, 466

(56) References Cited

U.S. PATENT DOCUMENTS 1,675,729 A * 7/1928 Reynolds ..... 81/177.7 X
4,819,523 A * 4/1989 Souza ..... 81/177.2

* cited by examiner

*Primary Examiner*—D. S. Meislin

(57) ABSTRACT

A ratchet wrench having a labor saving structure includes a drive shank provided with a fixed plate defining a first circular hole and a rivet hole; a drive arm pivotally mounted on the fixed plate and defining a second circular hole and an elongated arcuate hole; a drive head mounted in the circular hole of the drive arm; a rivet extending through the elongated arcuate slot of the drive arm and secured in the rivet hole of the fixed plate; and C-shaped snap rings snapping and securing the fixed plate, the drive arm and the drive head together. When the drive shank is driven to rotate, each of the rivets can push the drive arm along the elongated arcuate slot, thereby forming a deflective leverage labor saving effect.

4 Claims, 10 Drawing Sheets

RATCHET WRENCH HAVING A LABOR SAVING STRUCTURE

BACKGROUND OF THE INVENTION

1. Field of the Invention

The present invention relates to a ratchet wrench having a labor saving structure, and more particularly to ratchet wrench having a labor saving structure, wherein, the drive head of the ratchet wrench is mounted in the toothed circular hole of the drive arm, the toothed circular hole has one side or two sides each defining an elongated arcuate hole, a rivet extending through the elongated arcuate slot of the drive arm and secured in the rivet hole of the fixed plate, whereby when the drive shank is driven to rotate, each of the rivets can push the drive arm along the elongated arcuate slot so that the drive arm produces a deflective effect to the drive head, thereby achieving a labor saving purpose by the principle of leverage.

2. Description of the Related Prior Art

In general, a conventional ratchet wrench in accordance with the prior art is not provided with a labor saving structure. Thus, the operator may have to exert a large force to drive the handle, thereby achieving the purpose of releasing or locking the workpiece. In such a manner, the operator has to exert a large force for driving the handle, thereby wasting the operator's energy and easily causing inconvenience to the operator.

SUMMARY OF THE INVENTION

The primary objective of the present invention is to provide a ratchet wrench that can achieve a labor saving purpose by the principle of leverage.

In accordance with the present invention, there is provided a ratchet wrench having a labor saving structure, comprising:

- a drive shank having a front end provided with a fixed plate, the fixed plate having a center defining a first circular hole and having two sides each defining a rivet hole located beside the first circular hole;
- a drive arm pivotally mounted on the fixed plate and having a center defining a second circular hole and having two sides each defining an elongated arcuate hole located beside the second circular hole and aligning with the rivet hole of the fixed plate;
- a drive head mounted in the first circular hole of the fixed plate and the second circular hole of the drive arm;
- two rivets each extending through the elongated arcuate slot of the drive arm and each secured in the rivet hole of the fixed plate; and
- two C-shaped snap rings each respectively mounted on the drive head for snapping and securing the fixed plate, the drive arm and the drive head together;
- wherein, when the drive shank is driven to rotate, each of the rivets can push the drive arm along the elongated arcuate slot, thereby forming a deflective leverage labor saving effect.

In accordance with the present invention, the fixed plate is located at a position lower than that of the drive shank.

In accordance with the present invention, the fixed plate and the drive arm are in parallel with the drive shank or in perpendicular with the drive shank.

In accordance with another embodiment of the present invention, the drive shank has two sides each provided with a positioning plate, and the ratchet wrench further comprises two lever arms each having a first end pivotally connected with the drive arm and the fixed plate, and a second end pivotally connected with the positioning plate of the drive shank.

Further benefits and advantages of the present invention will become apparent after a careful reading of the detailed description with appropriate reference to the accompanying drawings.

DETAILED DESCRIPTION OF THE INVENTION

Figure 1:
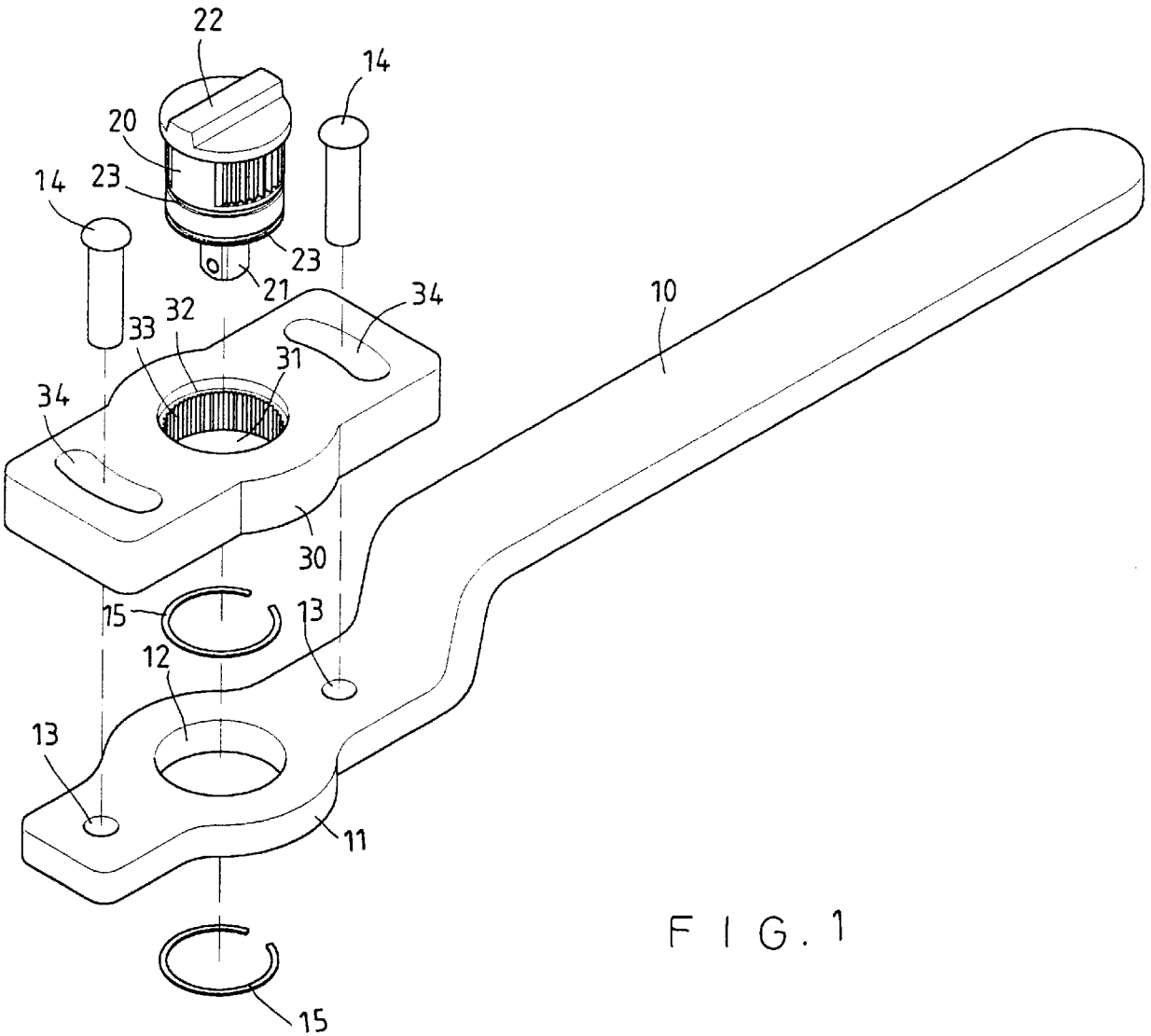
FIG. 1 is an exploded perspective view of a ratchet wrench having a labor saving structure in accordance with a first embodiment of the present invention.
Figure 2:
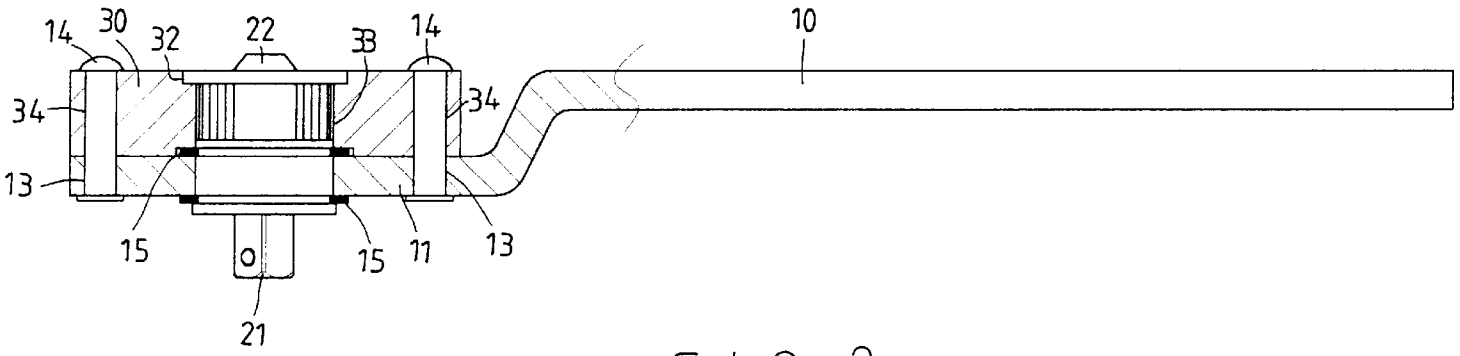
FIG. 2 is a side plan cross-sectional view of the ratchet wrench having a labor saving structure as shown in FIG. 1.
Figure 3:
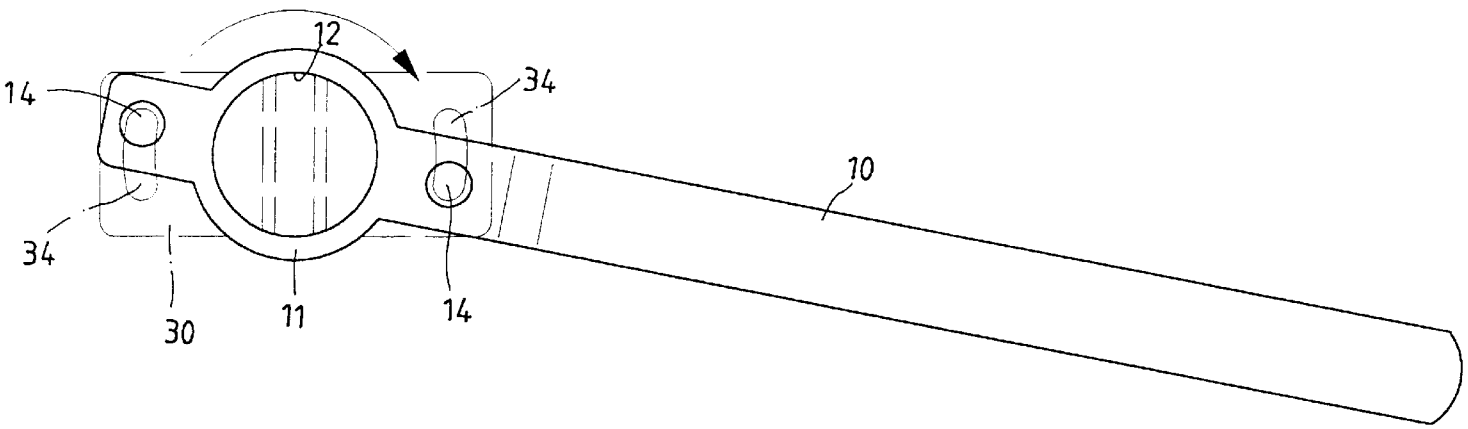
FIG. 3 is a top plan operational cross-sectional view of the ratchet wrench having a labor saving structure as shown in FIG. 1.

Referring to the drawings and initially to FIGS. 1–3, a ratchet wrench having a labor saving structure in accordance with a first embodiment of the present invention comprises a drive shank 10 having a front end provided with a straight directed fixed plate 11, the fixed plate 11 having a center defining a first circular hole 12 and having two sides each defining a rivet hole 13 located beside the first circular hole 12; a straight directed drive arm 30 pivotally mounted on the fixed plate 11 and having a center defining a second circular hole 31 and having two sides each defining an elongated arcuate hole 34 located beside the second circular hole 31 and aligning with the rivet hole 13 of the fixed plate 11, the second circular hole 31 provided with a stepped edge 32 and a plurality of ratchet teeth 33; a drive head 20 mounted in the first circular hole 12 of the fixed plate 11 and the second circular hole 31 of the drive arm 30, a switch knob 22 formed on top of the drive head 20 for adjusting the direction of a positive rotation or a reverse rotation, a square head 21 formed on bottom of the drive head 20 protruding outward from the first circular hole 12 of the fixed plate 11; two rivets 14 each extending through the elongated arcuate slot 34 of the drive arm 30 and each secured in the rivet hole 13 of the fixed plate 11; and two C-shaped snap rings 15 each respectively mounted in the positioning annular grooves 23 defined in the drive head 20 for snapping and securing the fixed plate 11, the drive arm 30 and the drive head 20 together.

The fixed plate 11 is located at a position lower than that of the drive shank 10. The fixed plate 11 and the drive arm 30 are in parallel with the drive shank 10.

In operation, referring to FIG. 3, when the drive shank 10 is driven to rotate, each of the rivets 14 can push the drive arm 30 along the elongated arcuate slot 34, thereby forming a deflective leverage action, and achieving a labor saving effect.

Figure 4:
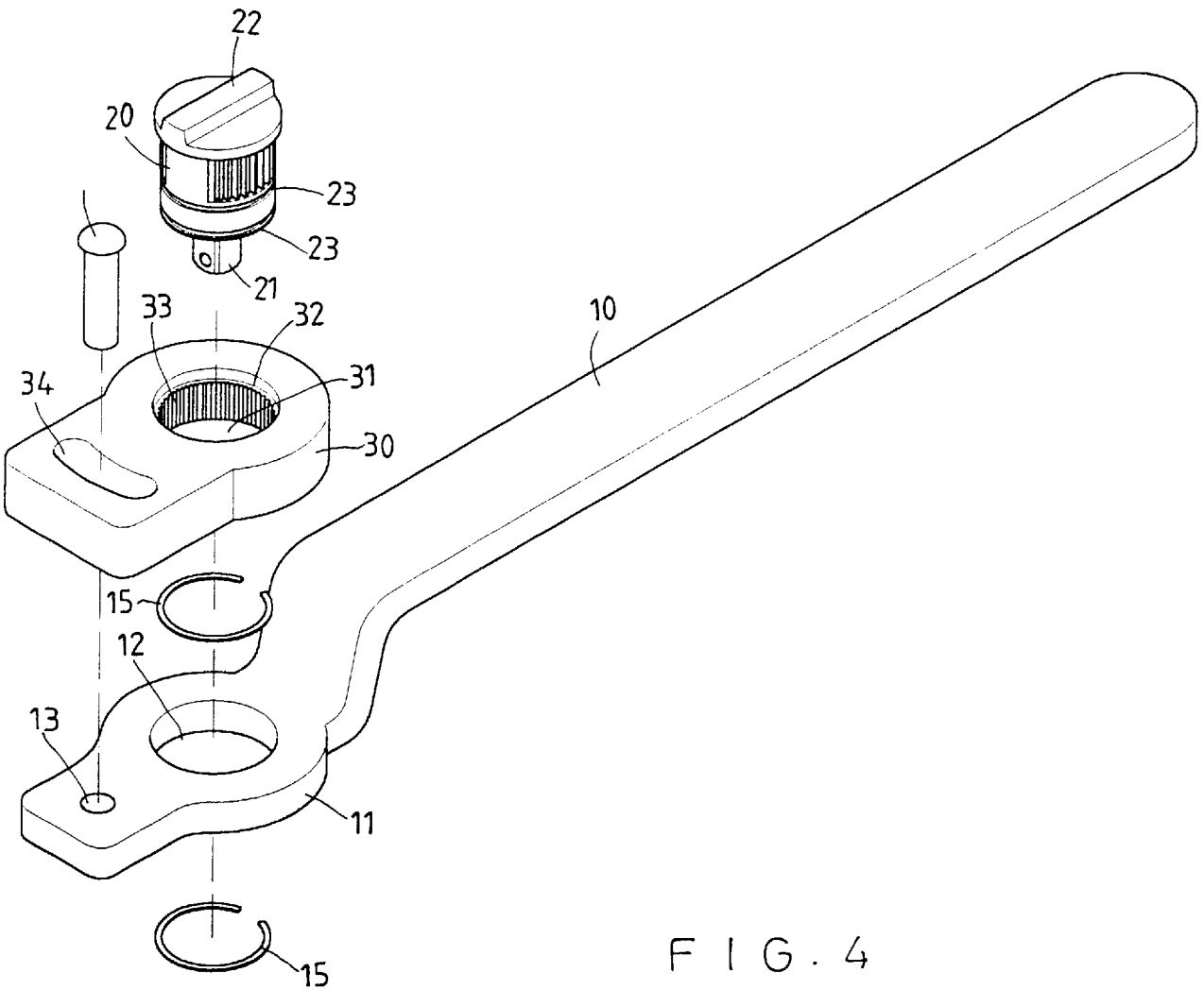
FIG. 4 is an exploded perspective view of a ratchet wrench having a labor saving structure in accordance with a second embodiment of the present invention.
Figure 5:
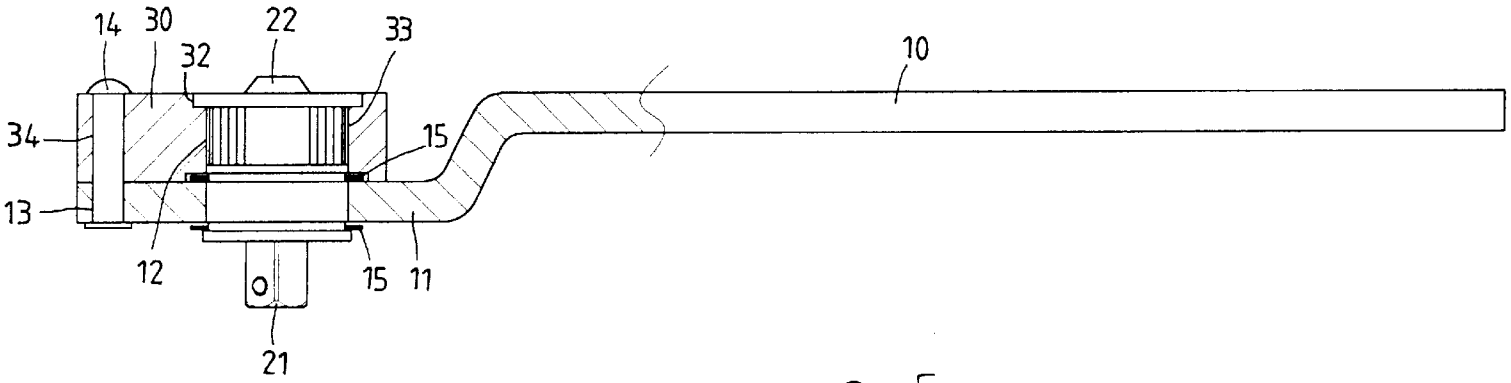
FIG. 5 is a side plan cross-sectional view of the ratchet wrench having a labor saving structure as shown in FIG. 4.
Figure 6:
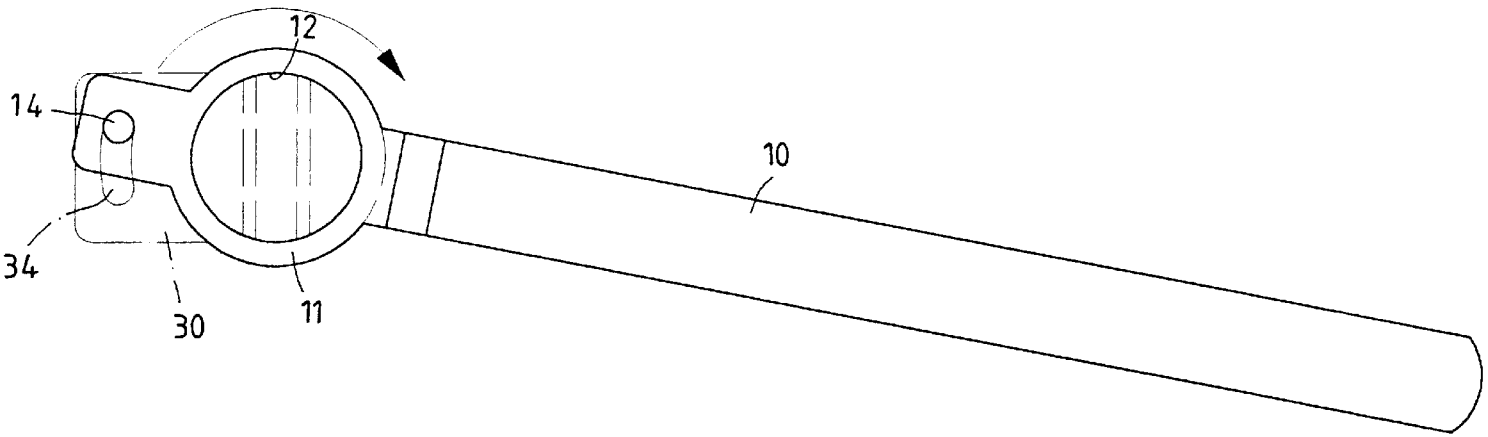
FIG. 6 is a top plan operational cross-sectional view of the ratchet wrench having a labor saving structure as shown in FIG. 4.

Referring to FIGS. 4–6, a ratchet wrench having a labor saving structure in accordance with a second embodiment of the present invention comprises a drive shank 10 having a front end provided with a straight directed fixed plate 11, the fixed plate 11 having a center defining a first circular hole 12 and having one side defining a rivet hole 13 located beside the first circular hole 12; a straight directed drive arm 30 pivotally mounted on the fixed plate 11 and having a center defining a second circular hole 31 and having one side defining an elongated arcuate hole 34 located beside the second circular hole 31 and aligning with the rivet hole 13 of the fixed plate 11, the second circular hole 31 provided with a stepped edge 32 and a plurality of ratchet teeth 33; a drive head 20 mounted in the first circular hole 12 of the fixed plate 11 and the second circular hole 31 of the drive arm 30, a switch knob 22 formed on top of the drive head 20 for adjusting the direction of a positive rotation or a reverse rotation, a square head 21 formed on bottom of the drive head 20 protruding outward from the first circular hole 12 of the fixed plate 11; a rivet 14 extending through the elongated arcuate slot 34 of the drive arm 30 and secured in the rivet hole 13 of the fixed plate 11; and two C-shaped snap rings 15 each respectively mounted in the positioning annular grooves 23 defined in the drive head 20 for snapping and securing the fixed plate 11, the drive arm 30 and the drive head 20 together.

The fixed plate 11 is located at a position lower than that of the drive shank 10. The fixed plate 11 and the drive arm 30 are in parallel with the drive shank 10.

In operation, referring to FIG. 6, when the drive shank 10 is driven to rotate, the rivet 14 can push the drive arm 30 along the elongated arcuate slot 34, thereby forming a deflective leverage action, and achieving a labor saving effect.

Figure 7:
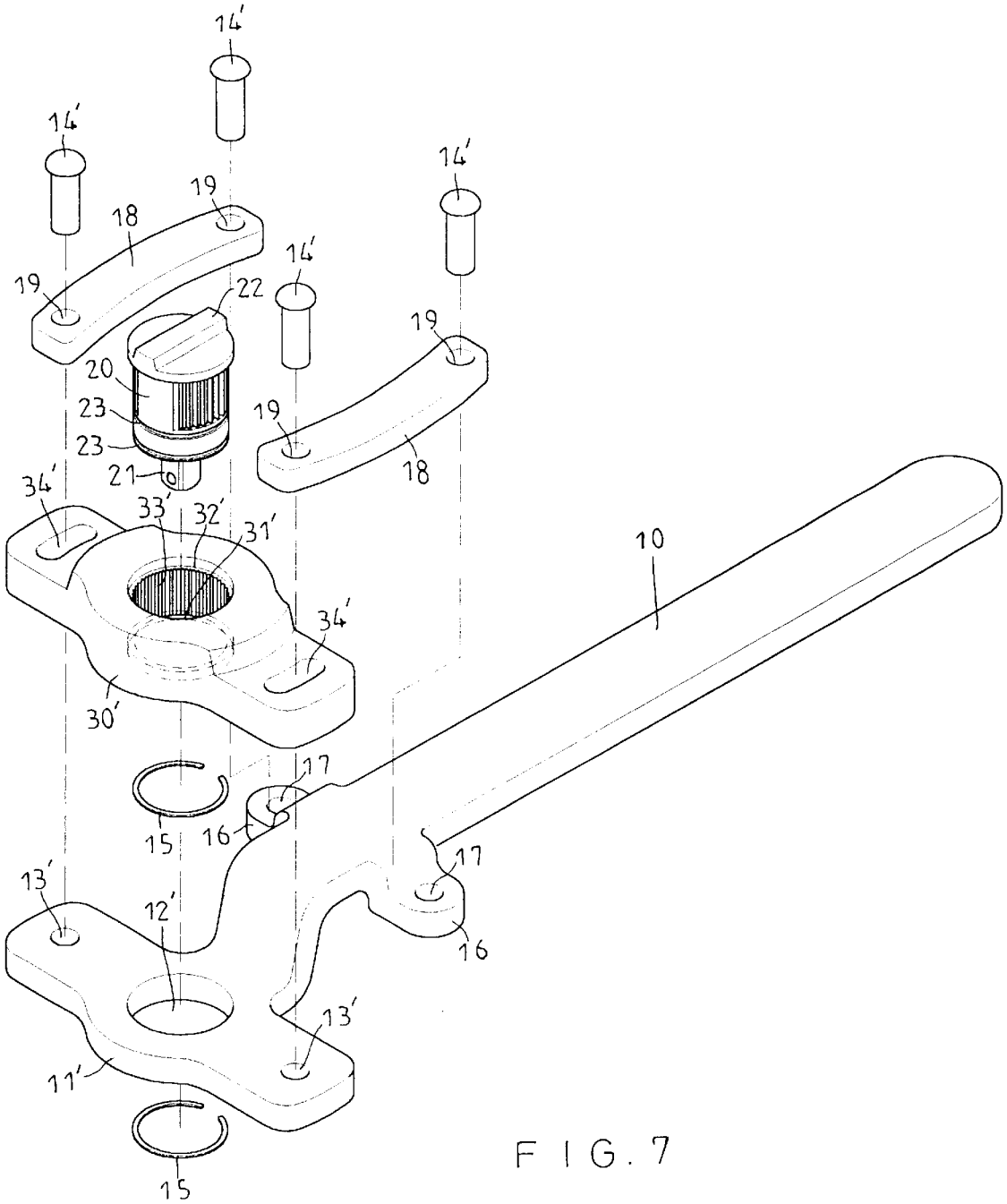
FIG. 7 is an exploded perspective view of a ratchet wrench having a labor saving structure in accordance with a first embodiment of the present invention.
Figure 8:
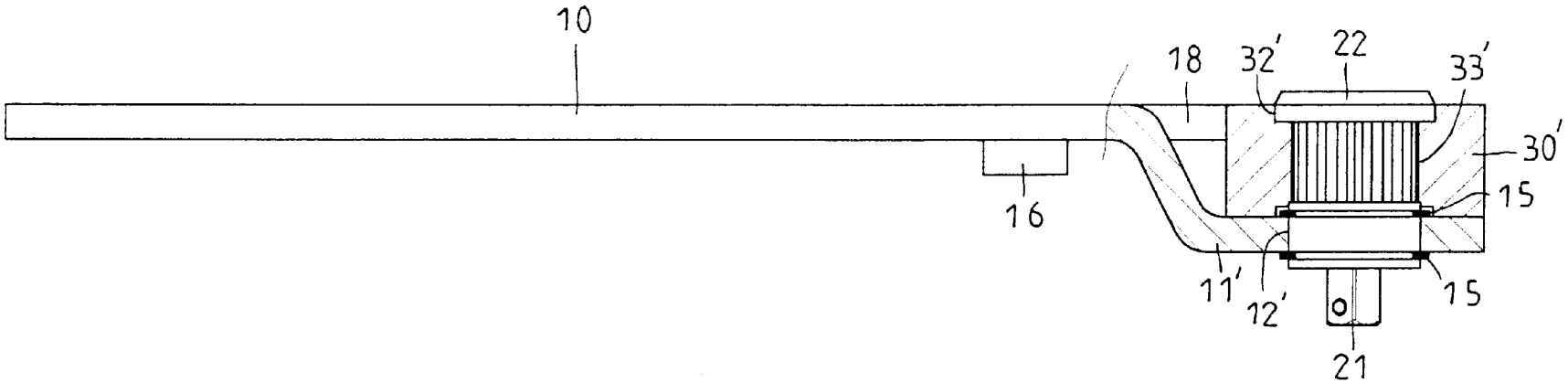
FIG. 8 is a side plan cross-sectional view of the ratchet wrench having a labor saving structure as shown in FIG. 7.
Figure 9:
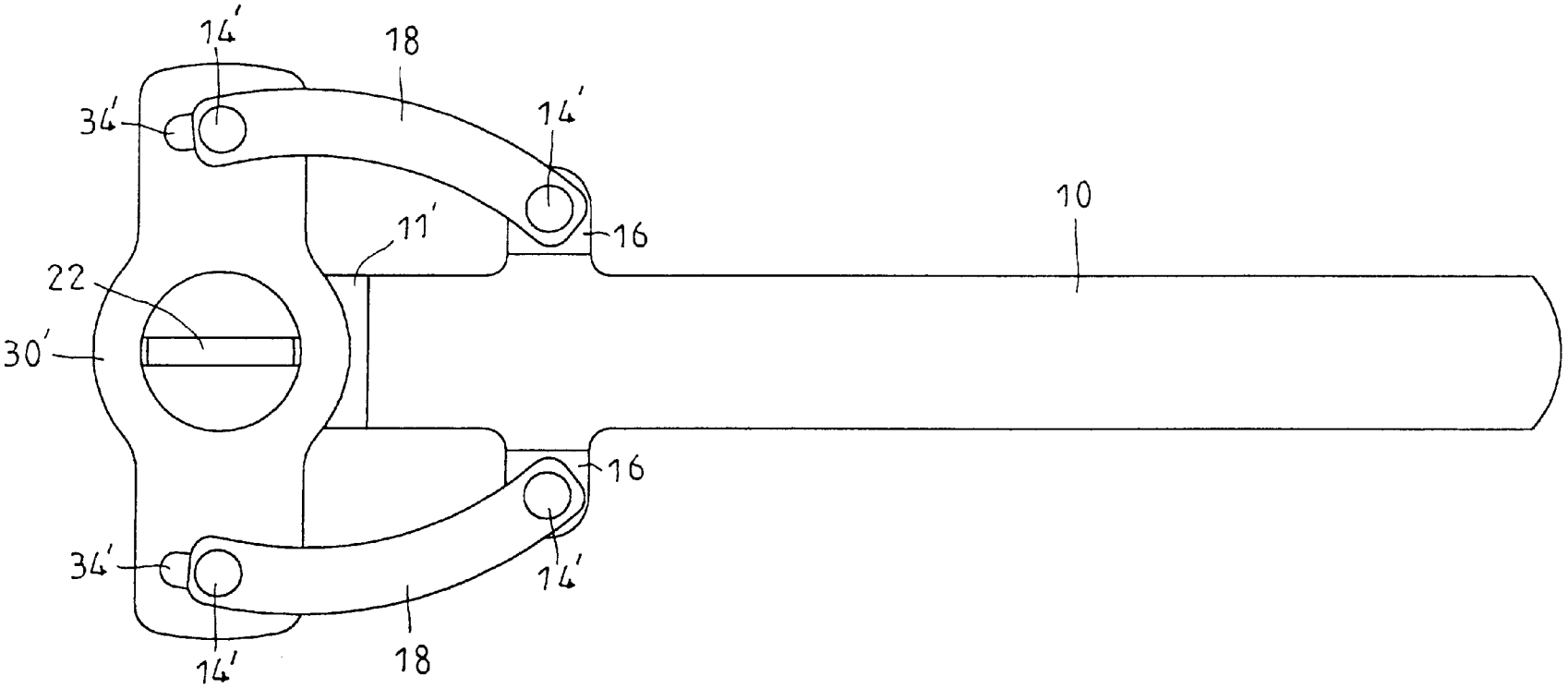
FIG. 9 is a top plan view of the ratchet wrench having a labor saving structure as shown in FIG. 7.

Referring to FIGS. 7–9, a ratchet wrench having a labor saving structure in accordance with a third embodiment of the present invention comprises a drive shank 10 having a front end provided with a transverse directed fixed plate 11', the fixed plate 11' having a center defining a first circular hole 12' and having two sides each defining a rivet hole 13' located beside the first circular hole 12', the drive shank 10 having two sides each provided with a transverse directed positioning plate 16 defining a rivet hole 17; a transverse directed drive arm 30' pivotally mounted on the fixed plate 11' and having a center defining a second circular hole 31' and having two sides each defining an elongated arcuate hole 34' located beside the second circular hole 31 ' and aligning with the rivet hole 13' of the fixed plate 11', the second circular hole 31' provided with a stepped edge 32' and a plurality of ratchet teeth 33'; a drive head 20 mounted in the first circular hole 12' of the fixed plate 11' and the second circular hole 31' of the drive arm 30', a switch knob 22 formed on top of the drive head 20 for adjusting the direction of a positive rotation or a reverse rotation, a square head 21 formed on bottom of the drive head 20 protruding outward from the first circular hole 12' of the fixed plate 11'; two lever arms 18 each having a first end defining a rivet hole 19 pivotally connected with the drive arm 30' and the fixed plate 11', and a second end defining a rivet hole 19 pivotally connected with the positioning plate 16 of the drive shank 10; two rivets 14' each extending through the rivet hole 19 of the lever arm 18, the elongated arcuate slot 34' of the drive arm 30' and each secured in the rivet hole 13' of the fixed plate 11'; two rivets 14' each extending through the rivet hole 19 of the lever arm 18, and the rivet hole 17 of the positioning plate 16 of the drive shank 10; and two C-shaped snap rings 15 each respectively mounted in the positioning annular grooves 23 defined in the drive head 20 for snapping and securing the fixed plate 11', the drive arm 30' and the drive head 20 together.

The fixed plate 11' is located at a position lower than that of the drive shank 10. The fixed plate 11' and the drive arm 30' are in perpendicular with the drive shank 10.

Figure 10:
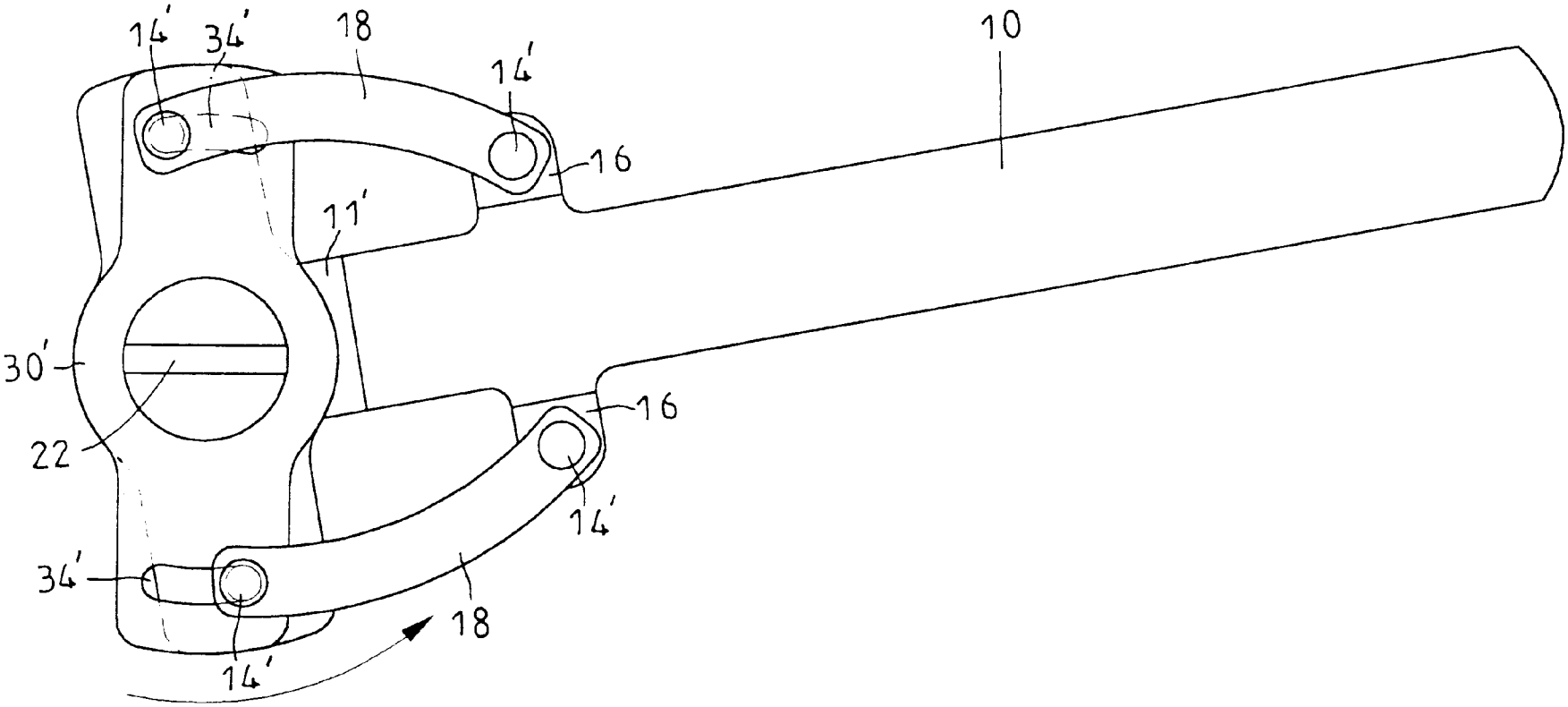
FIG. 10 is an operational view of the ratchet wrench having a labor saving structure as shown in FIG. 9.

In operation, referring to FIG. 10, when the drive shank 10 is driven to rotate, each of the rivets 14' on the lever arm 18 can push the drive arm 30' along the elongated arcuate slot 34', thereby forming a deflective leverage action, and achieving a labor saving effect.

Figure 11:
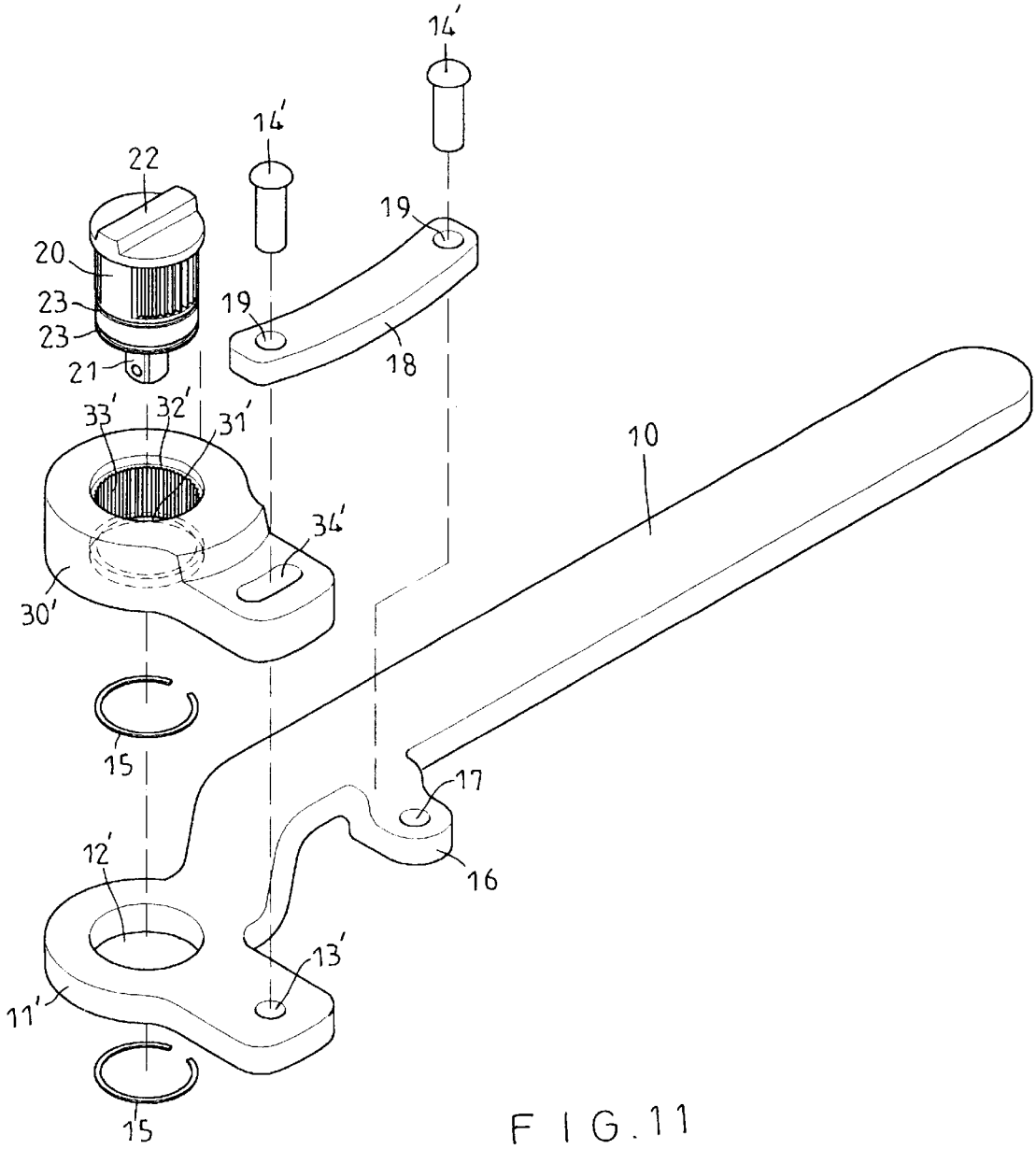
FIG. 11 is an exploded perspective view of a ratchet wrench having a labor saving structure in accordance with a fourth embodiment of the present invention.
Figure 12:
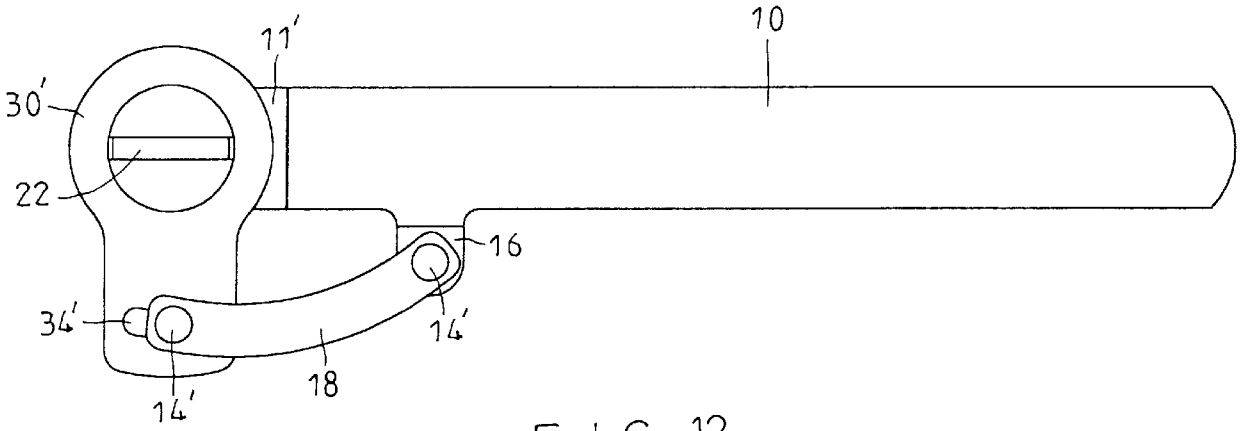
FIG. 12 is a top plan operational cross-sectional view of the ratchet wrench having a labor saving structure as shown in FIG. 11.
Figure 13:
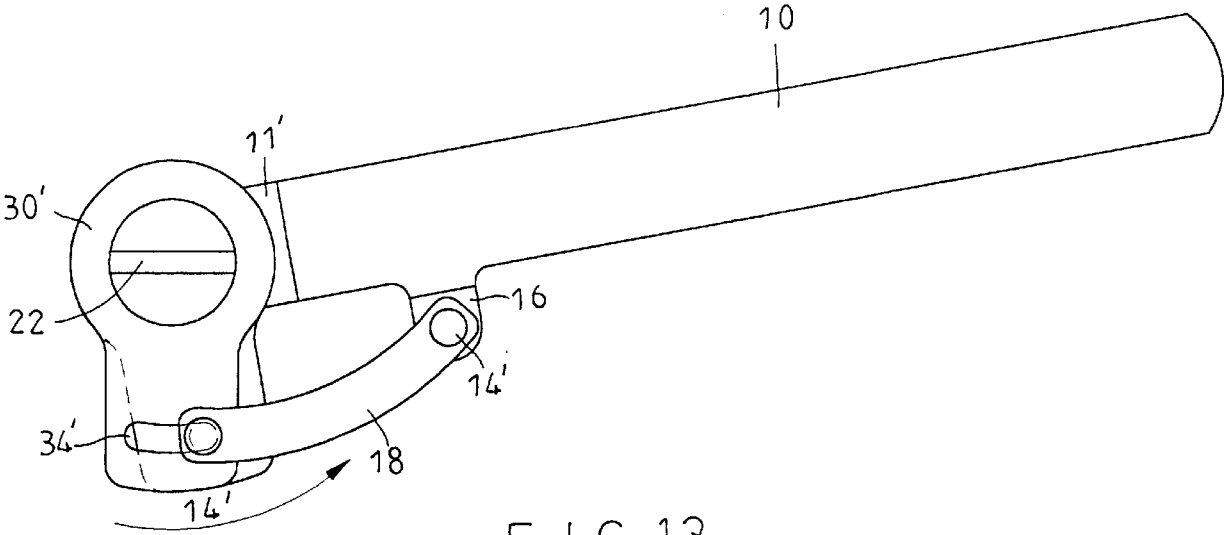
FIG. 13 is an operational view of the ratchet wrench having a labor saving structure as shown in FIG. 12.

Referring to FIGS. 11–13, a ratchet wrench having a labor saving structure in accordance with a fourth embodiment of the present invention comprises a drive shank 10 having a front end provided with a transverse directed fixed plate 11', the fixed plate 11' having a center defining a first circular hole 12' and having one side defining a rivet hole 13' located beside the first circular hole 12', the drive shank 10 having one side provided with a transverse directed positioning plate 16 defining a rivet hole 17; a transverse directed drive arm 30' pivotally mounted on the fixed plate 11' and having a center defining a second circular hole 31' and having one side defining an elongated arcuate hole 34' located beside the second circular hole 31' and aligning with the rivet hole 13' of the fixed plate 11', the second circular hole 31' provided with a stepped edge 32' and a plurality of ratchet teeth 33'; a drive head 20 mounted in the first circular hole 12' of the fixed plate 11' and the second circular hole 31' of the drive arm 30', a switch knob 22 formed on top of the drive head 20 for adjusting the direction of a positive rotation or a reverse rotation, a square head 21 formed on bottom of the drive head 20 protruding outward from the first circular hole 12' of the fixed plate 11'; a lever arm 18 having a first end defining a rivet hole 19 pivotally connected with the drive arm 30' and the fixed plate 11', and a second end defining a rivet hole 19 pivotally connected with the positioning plate 16 of the drive shank 10; a rivet 14' extending through the rivet hole 19 of the lever arm 18, the elongated arcuate slot 34' of the drive arm 30' and secured in the rivet hole 13' of the fixed plate 11'; a rivet 14' extending through the rivet hole 19 of the lever arm 18, and the rivet hole 17 of the positioning plate 16 of the drive shank 10; and two C-shaped snap rings 15 each respectively mounted in the positioning annular grooves 23 defined in the drive head 20 for snapping and securing the fixed plate 11', the drive arm 30' and the drive head 20 together.

The fixed plate 11 ' is located at a position lower than that of the drive shank 10. The fixed plate 11' and the drive arm 30' are in perpendicular with the drive shank 10.

In operation, referring to FIG. 13, when the drive shank 10 is driven to rotate, the rivet 14' on the lever arm 18 can push the drive arm 30' along the elongated arcuate slot 34', thereby forming a deflective leverage action, and achieving a labor saving effect.

Although the invention has been explained in relation to its preferred embodiment as mentioned above, it is to be understood that many other possible modifications and variations can be made without departing from the scope of the present invention.

What is claimed is:

1. A ratchet wrench having a labor saving structure, comprising:

a drive shank having a front end provided with a fixed plate, said fixed plate having a center defining a first circular hole and having two sides each defining a rivet hole located beside said first circular hole;

a drive arm pivotally mounted on said fixed plate and having a center defining a second circular hole and having two sides each defining an elongated arcuate hole located beside said second circular hole and aligning with said rivet hole of said fixed plate;

a drive head mounted in said first circular hole of said fixed plate and said second circular hole of said drive arm;

two rivets each extending through said elongated arcuate slot of said drive arm and each secured in said rivet hole of said fixed plate; and two C-shaped snap rings each respectively mounted on said drive head for snapping and securing said fixed plate, said drive arm and said drive head together;

wherein, when said drive shank is driven to rotate, each of said rivets can push said drive arm along said elongated arcuate slot, thereby forming a deflective leverage labor saving effect.

2. The ratchet wrench having a labor saving structure in accordance with claim 1, wherein said fixed plate is located at a position lower than that of said drive shank.

3. The ratchet wrench having a labor saving structure in accordance with claim 1, wherein said fixed plate and said drive arm are in parallel with said drive shank or in perpendicular with said drive shank.

4. The ratchet wrench having a labor saving structure in accordance with claim 1, wherein said drive shank has two sides each provided with a positioning plate, and said ratchet wrench further comprises two lever arms each having a first end pivotally connected with said drive arm and said fixed plate, and a second end pivotally connected with said positioning plate of said drive shank.

* * * * *